United States Patent [19]

Oyabu et al.

[11] 4,320,107

[45] Mar. 16, 1982

[54] PROCESS FOR PRODUCING CARBON FIBERS

[75] Inventors: Mikio Oyabu, Shozan; Kenji Fukuda, Aoba; Keiichi Hirata, Enmeiji, all of Japan

[73] Assignee: Mitsui Coke Co. Ltd., Tokyo, Japan

[21] Appl. No.: 96,971

[22] Filed: Nov. 23, 1979

[30] Foreign Application Priority Data

Dec. 21, 1978 [JP] Japan ..... 53-156910
Dec. 25, 1978 [JP] Japan ..... 53-158669

[51] Int. Cl.[3] ..... D01F 9/14

[52] U.S. Cl. ..... 423/447.6; 264/29.2; 423/447.2

[58] Field of Search ..... 423/447.1, 447.2, 447.4, 423/447.6, 449, 445; 264/29.2; 208/8 LE

[56] References Cited

U.S. PATENT DOCUMENTS

| | | | |
|---|---|---|---|
| 3,629,379 | 12/1971 | Otani | 423/447.6 |
| 3,767,741 | 10/1973 | Toyoguchi et al. | 423/447.4 X |
| 3,959,448 | 5/1976 | Fuller et al. | 423/447.6 |
| 4,055,583 | 10/1977 | Kolling et al. | 423/447.4 |
| 4,146,576 | 3/1979 | Wyss | 423/447.4 |
| 4,210,517 | 7/1980 | Murakami et al. | 208/8 LE |

*Primary Examiner*—Edward J. Meros

[57] ABSTRACT

A fibrous carbon is prepared by dissolving coal in a hydrocarbon solvent by heating under hydrogen pressure, by subjecting to melt spinning a solvent-refined coal obtained by successively removing insoluble residues and the solvent from the resultant solution, by making the fiber thus obtained non-fusible, and then by subjecting same to carbonization. The melt spinning may be effected by mixing a highly aromatic bituminous substance with the solvent refined coal. Alternatively, the solvent-refined coal may be pretreated prior to melt spinning by extracting it with a non-aromatic solvent to remove soluble components therefrom.

2 Claims, No Drawings

PROCESS FOR PRODUCING CARBON FIBERS

BACKGROUND OF THE INVENTION (a) Field of the Invention

This invention relates to an improved process for producing carbon fibers and, more particularly, for producing carbon fibers in which solvent refined coal (SRC) obtained by heating coal under hydrogen pressure in a solvent is used as the starting material.

(b) Description of the Prior Art

Processes for producing a carbn fibers such as carbon fibers and graphite fibers can be divided into two main classes with respect to the starting material employed: one is a process in which a natural fiber or a synthetic fiber is used as starting material and another is a process in which petroleum pitch or coal-tar pitch is used as the starting material.

The former has the disadvantage that a natural or a synthetic fiber, such as polyacrylonitrile and the like is a very expensive raw material and that the carbonization yield of the fiber is rather low. On the other hand, the latter process requires a heat treatment of the pitch for improving spinnability and for rendering the fiber non-fusible. It is very difficult to maintain uniformity in the properties of carbon fibers prepared from petroleum pitch and coal-tar pitch, due to the fact that neither petroleum pitch nor coal-tar pitch is originally uniform and that heat treatment thereof results in considerable nonuniformity in composition. For example, heat treatment of a petroleum pitch causes pyrolysis and condensation polymerization at lower temperatures thus creating difficulty in the preparation of a pitch with the preferred properties. The starting material should have a softening point in the range of from about 150° to 250° C. and a high carbonization yield.

In order to overcome the difficulties of the prior art processes, it is necessary to adjust the properties of the starting material by subjecting these pitches to a heat pre-treatment, but the pre-treatment makes them nonuniform in their compositions. Further, the use of a highly aromatic starting material such as coal-tar pitch, petroleum pitch or the like has the disadvantage that the time required for making them non-fusible is prolonged, because the speed of oxidation of an aromatic ring is lower than that of an aliphatic chain or of an alicyclic ring. Accordingly, when coal-tar pitch or petroleum pitch is used, the conversion of an aromatic ring into an alicyclic ring by hydrogenation is conducted in advance. Further, in a process in which these pitches are used as starting material, the heating to render non-fusible a spun fiber must be effected at a rate of from 0.5° to 1° C./min, unless the fiber is subjected to a pretreatment with ozone, because higher heating rates than the above range cause fusing between the fibers.

SUMMARY OF THE INVENTION

It is therefore an object of the present invention to provide an improved process for producing carbon fibers.

It is another object of the present invention to provide an improved process for producing carbon fibers in which the treatment for making the spun fiber non-fusible can be effected easily.

It is a further object of the present invention to provide an improved process for producing carbon fibers at a high carbonization yield.

These and other objects may be accomplished by a process which comprises dissolving coal by heating in a hydrocarbon solvent under hydrogen pressure; removing insoluble residues and the hydrocarbon solvent successively to yield a solid solvent refined coal (SRC); subjecting the solvent refined coal to melt spinning to form fibers; heating the spun fiber in air to render them non-fusible; and the subjecting the non-fusible fibers to carbonization in an inert gas atmosphere.

The solvent refined coal (SRC) can be modified by subjecting it to extraction with a non-aromatic solvent, and removing the component soluble in the non-aromatic solvent by extraction. The SRC or modified SRC may also be mixed with a highly aromatic bituminous substance and subjected to melt spinning.

DETAILED DESCRIPTION OF THE INVENTION

Typical coals used as the starting material for the process of the present invention include bituminous coal, subbituminous coal, brown coal, lignite and peat moss.

Brown coal and lignite especially can be advantageously used in the present invention, because they are available in large quantities and at low prices. Moreover, control of depolymerization conditions makes it possible to obtain SRCs with almost identical chemical properties. Therefore, the present invention is not restricted by its starting material.

The solvent-refined coal is prepared by well known processes. Reference is made herein to copending patent application Ser. No. 943,070 filed Sept. 18, 1978 by H. Murakami et al and entitled "Preparation of Carbonaceous Products" and assigned to the same assignee, MITSUI COKE CO., LTD. and MITSUI MINING CO., LTD. As an example, coal, ground to appropriate particle size is mixed with a hydrocarbon solvent such as a fraction having a boiling point of from 200° to 400° C., in a weight ratio of coal/solvent in the range of from about 1:1 and 1:10 to form a slurry, and the soluble matter in the coal is dissolved by heating the slurry under a hydrogen pressure of from 3 to 300 kg/cm$^2$ at a temperature of from 300° to 500° C. The application of hydrogen pressure is effective in deflocculating the coal components into the solvent and to increase the degree of solubility of the coal. The heat dissolution time is set so that the slurry may be filtered sufficiently. Typical length for the treatment is in the range of from 10 to 240 minutes depending on the kind of coal used. After thoroughly dissolving the soluble matter of the coal in the solvent, the insoluble residues are separated by filtration, centrifuging or the like. Then the filtrate is distilled under reduced pressure at a bottom temperature of less than 350° C. to obtain the SRC and recover the solvent. A bottom temperature higher than 350° C. on the other hand accelerates the condensation polymerization and renders the properties of the SRC nonuniform.

The insolubles content of SRC is preferably 1% by weight or less, and most preferably 0.5% by weight or less. An insolubles content higher than 1% by weight makes spinning difficult and reduces the strength of the formed carbon fibers.

Further, the softening point of the SRC is preferably adjusted in the range of from about 160° and 250° C., and the adjustment can be made according to the conditions of solvent recovery. A softening point lower than 160° C. requires a prolonged period of time for rendering the fiber non-fusible, while a softening point higher than 250° C. makes melt-spinning difficult. The most preferable softening point is in the range of from 200° to 250° C.

In spinning the solvent refined coal, a single SRC may be used, or a mixture of two or more different SRCs with depolymerization conditions different from each other may be used as starting material for the spinning thereof.

Further, the solvent refined coal may be modified by extracting therefrom non-aromatic solvent soluble components by means of solvent extraction with a non-aromatic solvent. With such modifications, a low softening point component is removed and a modified high softening point SRC with uniform properties may be obtained. The modification makes it possible to obtain readily and with good reproducibility a modified high softening point SRC having the desired uniform properties in a starting material for the production of carbon fibers.

The modification procedure mentioned above will be further explained in detail hereinafter. The SRC is ground to 60 mesh and under; mixed with one or more non-aromatic solvent, for example, an aliphatic hydrocarbon having 3 to 10 carbon atoms such as prpane, butane, pentane, hexane, heptane, octane, nonane, decane and the like; or a monohydric aliphatic alcohol having 1 to 6 carbon atoms such as methanol, ethanol, propanol, butanol, pentanol, hexanol and the like; or a distillate fraction having a boiling point of 200° C. or lower; or a mixture of two or more of these non-aromatic solvents. The weight ratio of SRC to solvent may be in the range of from 1:5 to 1:20, and the low softening point component in the SRC is removed to obtain a modified SRC having a softening point of from 200° to 250° C. and an ash content of 0.5% by weight or less.

A softening point lower than 200° C. of the modified SRC requires a prolonged period of time for rendering the fiber non-fusible, while a softening point higher than 250° makes melt spinning difficult. Further, an ash content greater than 0.5% by weight causes an increase in voids as well as a reduction in strength of a carbon fiber, which makes the modified SRC unsuitable as starting material.

The use of an aromatic solvent with high dissolving ability such as benzene and toluene in preparing the modified SRC increases considerably the softening point of the SRC obtained and makes melt spinning very difficult, which, in turn, makes an aromatic solvent unsuitable.

The SRC or modified SRC may be mixed with a highly aromatic bituminous substance, such as coal-tar pitch free of solids, or petroleum pitch. The weight ratio of bituminous substance to SRC is preferably in the range of from 0.05:1 to 1:1.

The SRC, modified SRC, or mixture of SRC or modified SRC with a highly aromatic bituminous substance is spun by a conventional melt spinning process to form fibers. Reference is made herein to U.S. Pat. No. 3,629,379 in which one such conventional process is described. The melt spinning temperature is preferably higher than the softening point of the starting material by some 30° to 70° C.

The fiber obtained is rendered non-fusible as described hereinafter. That is, the fiber is heated in air stream at from room temperature to a temperature higher than its softening point by 60° to 80° C. at a heating rate ranging from 3° C./min. to 10° C./min. A heating rate higher than 10° C./min. causes a partial fusion of the fibers. The time required for rendering the fiber non-fusible may be shortened by ozone oxidation. In the present invention, no coating by a curing agent such as a peroxide or a metal chloride is employed, as it is conventionally the case in making a fiber non-fusible. Reference is made herein to Japanese Patent Publication No. 12375/1963 in which such coating by a curing agent is described. On the contrary, these coatings have been found to cause a loss in smoothness of the fiber and are responsible for a drop in strength and sheen thereof.

The fiber after having been made non-fusible, may be calcined and carbonized up to about 1000° C. at a heating rate of 20° C./min. or less and in an inert atmosphere with or without stretching. A heating rate greater than 20° C./min. causes a reduction in strength of the carbon fiber and/or an increase in the number of voids on the surface of the fiber.

The carbon fiber thus obtained can be graphitized by calcining it at a temperature of 2000° C. or higher to obtain a graphite fiber.

According to the process of the present invention, the treatment of making the fiber spun non-fusible can be effected easily, because the starting material is low hydrogenolysis products having an aromatic structure and/or alicyclic structure with aliphatic side chains oxidizable relatively readily, and therefore, these products can be readily made non-fusible. Moreover, the process of the present invention is also characterized in that the carbonization yield is high, and the carbon fiber thus obtained has uniform properties and excellent strength. Further, the modified SRC obtained by the extraction of a SRC with a non-aromatic solvent has uniform properties due to the very low dissolving ability of the solvent, and contains almost no low softening point components. Accordingly, the spinnability of the modified SRC is improved and the rendering of the fiber non-fusible is facilitated.

The present invention will be illustrated by the following Examples, in which the percentages are by weight, "d.a.f." means "dry ash-free", and "t" denotes "metric ton".

EXAMPLE 1

Australian lignite was heated at 410° C. for 2 hours under a hydrogen pressure of 60 kg/cm$^2$G in tar middle oil in an amount equal to 5 times the weight thereof to dissolve the solvent soluble matter. The resultant solution was subjected to filtration and then to vacuum distillation under 10 mmHg at 260° C. to recover the solvent. The yield of the SRC was 43.2% (d.a.f.), the softening point thereof was 210° C., and the insolubles content was 0.1%. The SRC was spun at 270° C. The fiber obtained was heated in an oven from room temperature to 270° C. at a heating rate of 3° C./min. in an air stream.

When the oven reached 270° C., $N_2$ purging of the oven was effected, and then the fiber was heated up to 1000° C. at a rate of 5° C./min. in a nitrogen stream and was maintained at that temperature for one hour to obtain a carbon fiber. The carbon fiber had a diameter of from 12 to 15$\mu$ and a tensile strength of 13.7 t/cm$^2$.

EXAMPLE 2

Australian lignite was heated at 420° C. for one hour under a hydrogen pressure of 60 kg/cm$^2$G in tar middle oil in an amount equal to 3 times the weight thereof to dissolve the solvent soluble matter. The resultant solution was subjected to filtration, and then to vacuum distillation under 8 mmHg abs. at 280° C. to recover the solvent. The yield of the SRC was 61.2% (d.a.f.), the softening point thereof was 230° C., and the insoluble solids content was 0.3%. The SRC was spun at 295° C. The fiber obtained was heated in an oven from room temperature to 300° C. at a heating rate of 5.5° C./min. in an air stream. When the oven reached 300° C., a $N_2$ purging was effected and then the fiber was heated up to 1000° C. at a rate of 7.5° C./min. in a nitrogen stream and was maintained at that temperature for one hour to obtain a carbon fiber. The carbon fiber had a diameter of 10 to 12μ and a tensile strength of 13.0 t/cm$^2$.

EXAMPLE 3

Seven parts of the SRC obtained in Example 2 were mixed under nitrogen at 250° C. with one part of ethylene bottoms, and 2 parts of quinoline soluble matter of coal tar pitch, to obtain a pitch. The pitch had a softening point of 212° C. and an insolubles content of 0.2%. The pitch was spun at 275° C. The fiber obtained was heated in an oven from room temperature to 280° C. in an air stream at a rate of 6.0° C./min. When the oven reached 280° C., a $N_2$ purging of the oven was effected, the fiber was heated up to 1000° C. at a rate of 8° C./min. in a nitrogen stream, and maintained at that temperature for one hour to obtain a carbon fiber. The carbon fiber had a diameter of 12 to 14μ and a tensile strength of 12.6 t/cm$^2$.

EXAMPLE 4

Sub-bituminous coal was heated at 430° C. for one hour under a hydrogen pressure of 60 kg/cm$^2$G in tar middle oil in an amount equal to 3 times the weight thereof to dissolve the solvent soluble matter. The resultant solution was subjected to filtration, and the solvent was subjected to vacuum distillation under 10 mmHg at a bottom temperature of 320° C. to recover the solvent. The softening point of the SRC obtained was 181° C. The SRC was ground to 60 mesh and under, dispersed in n-heptane in an amount equal to 10 times the weight thereof, shaken for one hour at room temperature, and then filtered to remove the n-heptane soluble matter. The yield of the modified SRC based on the SRC was 92.6% the softening point was 208° C., and the ash content was 0.1%. The modified SRC was subjected to melt spinning at 260° C. The fiber obtained was heated in an oven from room temperature to 280° C. at a rate of 3° C./min. in an air stream. When the oven reached 280° C., a $N_2$ purging of the oven was effected and, the fiber was then heated up to 1000° C. at a rate of 10° C./min. in a nitrogen stream and maintained at that temperature for one hour to obtain a carbon fiber. The yield of the carbon fiber based on the modified SRC was 81.4%. The carbon fiber had a diameter of from 10 to 12μ and a tensile strength of 12.8 t/cm$^2$.

EXAMPLE 5

The coal depolymerized substance obtained in Example 4 with particle sizes of 60 mesh and under was dispersed im methanol in an amount equal to 10 times the weight thereof, shaken for one hour at room temperature, and then filtered to remove methanol insoluble matter. The yield of the modified SRC based on the SRC was 89.1%, the softening point was 215° C., and the ash content was 0.11%. The modified SRC was subjected to melt spinning. The fiber obtained was heated in an oven from room temperature to 280° C. at a rate of 4° C./min. in an air stream. When the oven reached 280° C., a $N_2$ purging of the oven was effected, the fiber was heated up to 1000° C. at a rate of 10° C./min. in nitrogen stream, and maintained at this temperature for one hour to obtain a carbon fiber. The yield of the carbon fiber based on the modified SRC was 83.4%. The carbon fiber had a diameter of from 10 to 13μ and a tensile strength of 13.4 t/cm$^2$.

EXAMPLE 6

Lignite was heated at 400° C. for 2 hours under a hydrogen pressure of 50 Kg/cm$^2$G in tar middle oil in an amount equal to 5 times the weight thereof. The resultant solution was subjected to filtration and then to vacuum distillation under 10 mmHg abs. at a bottom temperature of 350° C. to recover the solvent. The softening point of the coal depolymerized substance obtained was 198° C. and the ash content was 0.01% or less. The SRC was ground to 60 mesh and under, dispersed in a fraction distilled from pyrolysis of asphalt and having a boiling point lower than 200° C. in an amount equal to 5 times the weight thereof, and shaken at 50° C. for one hour to remove the solvent soluble matter. The yield of the modified SRC thus obtained based on the coal depolymerized substance was 94.6%, the softening point was 230° C., and the ash content was 0.01% or less. The modified SRC was subjected to melt spinning at 280° C. The fiber obtained was heated in an oven from room temperature to 300° C. at a rate of 7° C./min. in an air stream. When the oven reached 300° C., a $N_2$ purging of the oven was effected, and then the fiber was heated up to 1000° C., at a rate of 20° C./min. and maintained at this temperature for one hour to obtain a carbon fiber. The yield of the carbon fiber based on the modified SRC was 88.7%. The carbon fiber had a diameter of from 12 to 15μ and a tensile strength of 11.4 t/cm$^2$.

What is claimed is:

1. A process for producing carbon fibers which comprises:

(a) providing as a starting material a solid solvent-refined coal having a softening point of from 200° C. to 250° C. and an insolubles content of 0.5% by weight or less, said solid solvent-refined coal being obtained by hydrogenating coal in a hydrocarbon solvent at a temperature of 300°-500° C. under a hydrogen pressure of 3-300 Kg/cm$^2$ and eliminating the hydrocarbon solvent;

(b) subjecting said solvent-refined coal to melt spinning to form a fiber;

(c) heating said fiber in air at a rate of 3-10° C./minute to render said fiber non-fusible; and (d) carbonizing said non-fusible fiber in an inert atmosphere to form said carbon fiber.

2. A process according to claim 1 in which said heating to render said fiber non-fusible is effected at a temperature 60° to 80° C. higher than the softening point of said solvent-refined coal.

* * * * *